United States Patent [19]

Grierson

[11] Patent Number: 4,515,100

[45] Date of Patent: May 7, 1985

[54] ATTACHMENT FOR SAIL VEHICLES TO AUTOMATICALLY COMPENSATE FOR VARYING WIND PRESSURE

[76] Inventor: Robert A. Grierson, 11 Great Rd., Sudbury, Mass. 01776

[21] Appl. No.: 544,499

[22] Filed: Oct. 24, 1983

[51] Int. Cl.[3] ..... B63H 9/10

[52] U.S. Cl. ..... 114/97; 114/111; 114/213; 267/71

[58] Field of Search ..... 114/39, 90, 91, 97-99, 114/111, 112, 102, 213, 214, 215, 205, 298; 280/213; 272/135, 136, 137, 141; 267/70, 71, 72

[56] References Cited

U.S. PATENT DOCUMENTS

| | | | |
|---|---|---|---|
| 384,008 | 6/1888 | Wheeler | 267/71 |
| 1,471,121 | 9/1921 | Grasnick | 267/72 |
| 1,950,882 | 3/1934 | Gianini | 267/71 |
| 2,038,166 | 4/1936 | Deal | 280/213 |
| 2,364,901 | 12/1944 | Hicks | 267/70 |
| 2,709,980 | 6/1955 | Christie | 114/298 |
| 3,090,340 | 5/1963 | McCutchen | 114/102 |
| 3,557,733 | 1/1971 | Mathieu | 114/39 |
| 3,610,190 | 10/1971 | Palmer | 114/39 |
| 3,968,765 | 7/1976 | Menegus | 114/102 |
| 3,994,508 | 11/1976 | Danner | 114/102 |
| 4,047,493 | 9/1977 | Menegus | 114/102 |
| 4,406,240 | 9/1983 | Andersen | 114/102 |

FOREIGN PATENT DOCUMENTS

| | | | |
|---|---|---|---|
| 319391 | 5/1919 | Fed. Rep. of Germany | 114/111 |

*Primary Examiner*—Sherman D. Basinger
*Attorney, Agent, or Firm*—Irving M. Kriegsman

[57] ABSTRACT

A device for use in a sailing vehicle for automatically adjusting the angular position of a boom supporting a sail in response to varying wind pressures is disclosed. A pulley and an adjustment block are mounted for slidable movement inside an elongated tubular housing which is attached to the boom by a pair of brackets. A compression spring is also disposed inside the tubular housing between the pulley and the adjustment block for urging the pulley away from the adjustment block. An end block is fixedly mounted on the end of the housing nearest the adjustment block. An attachment line having a stop at one end extends into the housing through the end block around the pulley and back out through the end block. Structure is provided for selectively fixing the position of the adjustment block in the housing so as to set a predetermined initial pressure on the spring. In using the device, the other end of the line is secured to the body of the sailing vehicle and the adjustment block set to the desired position. Any increases in wind pressure on the sail, such as by sudden gusts of wind, will produce increased pulling on the line. This will cause the pulley to move toward the end block, compressing the spring and as a result producing more slack on the line which will relieve the pressure on the sail. Structure is also provided for locking the pulley in place if automatic compensation for changing wind pressure is not desired.

11 Claims, 13 Drawing Figures

ATTACHMENT FOR SAIL VEHICLES TO AUTOMATICALLY COMPENSATE FOR VARYING WIND PRESSURE

BACKGROUND OF THE INVENTION

The present invention relates generally to sail vehicles and more particularly to a device for use on a sail vehicle for automatically adjusting the angular position of a sail on a sail vehicle to compensate for changes in wind pressure.

In most sail vehicles containing a sail supported by a mast and a boom, the angular position of the boom relative to the mast is set by a line connecting the boom to the hull or other part of the sale vehicle. Increased pressure on the sail caused by sudden wind gusts is most often compensated for by manually adjusting the length of the line. As is very well known, this arrangement is not always satisfactory or adequate, for one reason or another, causing the sail vehicle to keel exesssively and often tip over.

In U.S. Pat. No. 2,038,166 there is disclosed a sail attachment for bicycles comprising a supporting structure mounted on the bicycle, said supporting structure including a pair of spaced uprights, a mast mounted for swinging movement in a vertical plane between the uprights, means for releasably securing the mast in vertical position, a boom mounted for swinging movement in a horizontal plane on the uprights, and a sail mounted on the mast and the boom.

In U.S. Pat. No. 3,090,340 there is disclosed a device for a sailing vehicle including a sail, a boom for supporting the foot of said sail, a spar for supporting the luff of said sail, a mast for supporting said spar on said vehicle, a flexible joint connected to said mast and to said spar at a single point intermediate the ends of said spar, pressure yielding means for connecting said boom to said vehicle between a point adjacent the stern of said vehicle and a point aft of the center of said boom, and a second pressure yielding means for connecting the tack end of said boom to said vehicle whereby wind pressure on said sail tends to rotate the sail about an axial line between said flexible joint and the first mentioned pressure yielding means and about the axis of said spar.

In U.S. Pat. No. 3,968,765 there is disclosed an apparatus for rotatably mounting a sail on racing yachts, sailboats and sailsleds, which includes a step adapted to be mounted on the hull of the craft, a boom, rigging connecting the sail to the boom, adapted to enable setting of the sail-to-boom orientation, and means for connecting the boom to the step so that the boom, sail and rigging are substantially freely rotatable about the step, and so that the orientation of the sail is maintained at a substantially constant angle with respect to the direction of the shifting apparent wind, to enable the sail to respond directly to shifting winds without requiring manual supervision, in order to provide maximum thrust with minimum drag for substantially increased racing yacht speed capabilities. A keel is connected to the bottom of the hull to rotate about a vertical axis through the aft portion of the keel, in order to minimize racing yacht heeling and hydrodynamic drag. A rudder is rotatably connected to the stern, which includes a horizontal stabilizing fin oriented thereon so as to minimize racing yacht bucking by damping the yacht's response to choppy seas.

In U.S. Pat. No. 3,994,508 there is disclosed a sail arrangement having a hollow flexible boom with a short stiffener rod disposed therein near the forward end, and a stiffener tube which may be moved along the exterior of the boom. The flexible boom provides both automatic sail positioning and the spilling of excess wind during sudden strong gusts. In a second embodiment, a pivoted rigid boom is controlled by an elastic cord. In a third embodiment, a spring assembly permits the mast to pivot to spill the wind during strong gusts.

Another patent of interest is U.S. Pat. No. 4,047,493.

It is an object of this invention to provide a device for use in automatically adjusting the angular position of a sail in a sailing vehicle relative to a mast in said sailing vehicle supporting the sail in order to compensate for varying wind pressure.

It is another object of this invention to provide a device as described above which is selectively adjustable to react only to pressures above a desired amount.

It is further object of this invention to provide a device as described above which can be set so that it will not compensate for varying wind pressures.

It is still a further object of this invention to provide a device as described above which is easy to install, easy to use, and very reliable.

The foregoing and other objects and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

A device for use in automatically adjusting the angular position of a sail in a sailing vehicle relative to a mast in said sailing vehicle supporting the sail in order to compensate for varying wind pressure constructed according to the teachings of the present invention includes an elongated tubular housing having a first end and a second end, a pulley slidably mounted in said housing, an end block fixedly mounted on said housing at said first end, a spring disposed inside said housing for urging said pulley away from said end block, means for selectively adjusting the pressure on the spring, means for mounting said housing on said sail vehicle, and a line extending into said housing through said first end around said pulley and back out of said housing through said first end and having means at one end for limiting inward movement of said line.

BRIEF DESCRIPTION OF THE DRAWINGS

In the drawings wherein like reference numerals represent like parts.

DETAILED DESCRIPTION OF A PREFERRED EMBODIMENT

Although the invention will be hereinafter described with specific reference to use on a sail boat, it is to be clearly understood that the invention is applicable to sail vehicles other than sail boats, such as sail bicycles, sail dune buggies, etc.

Figures 1, 2, 3, 4, 5, 6:
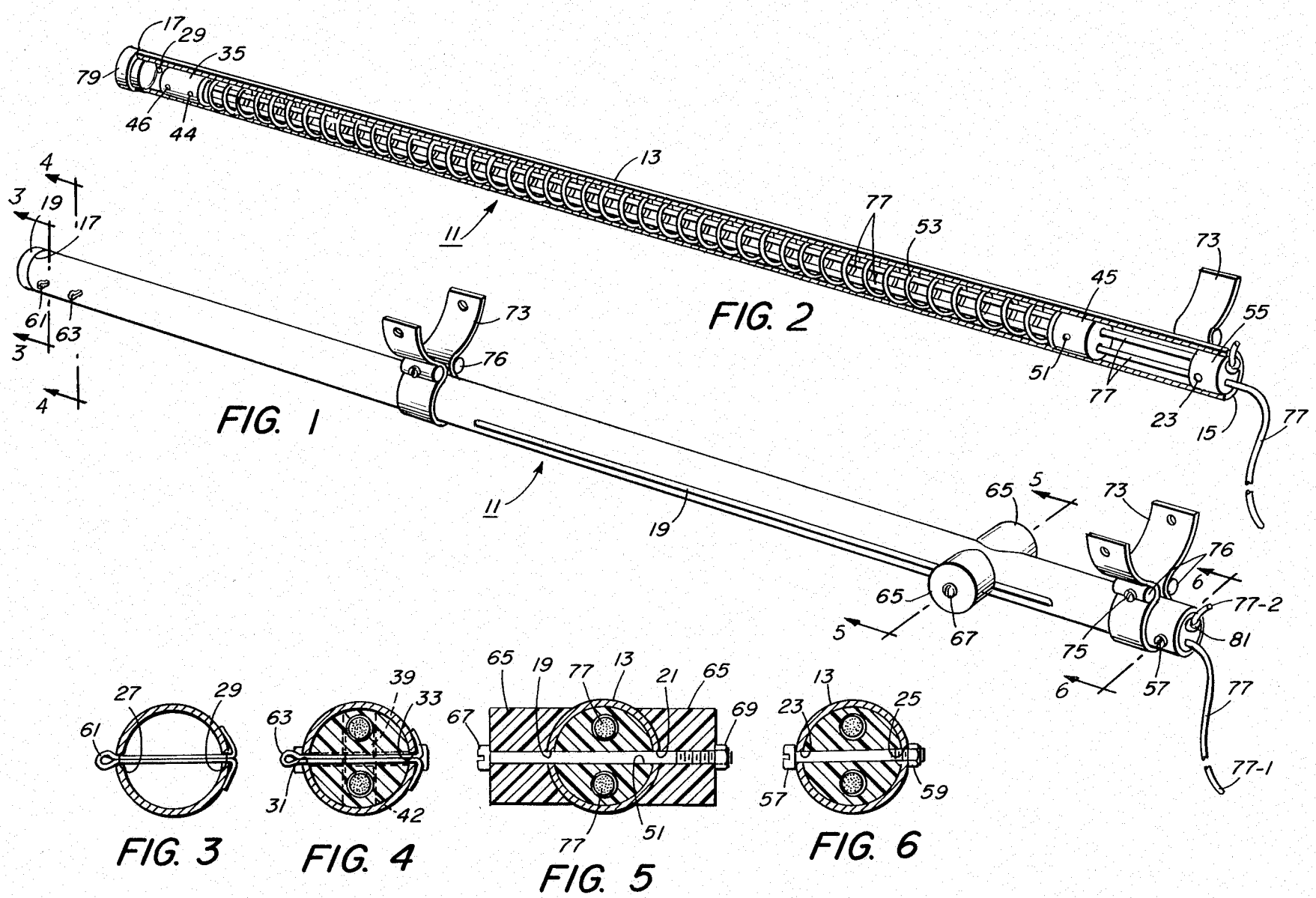
FIG. 1 is a perspective view of a device constructed according to the teachings of the present invention.
FIG. 2 is a longitudinal section view of the device shown in FIG. 1.
FIG. 3 is an enlarged section view taken along lines 3—3 in FIG. 1.
FIG. 4 is an enlarged section view taken along lines 4—4 in FIG. 1.
FIG. 5 is an enlarged section view taken along lines 5—5 in FIG. 1.
FIG. 6 is an enlarged section view taken along lines 6—6 in FIG. 1.

Referring now to the drawings, and in particular to FIGS. 1 and 2 there is illustrated an embodiment of a device constructed according to the teachings of the present invention and identified generally by reference numeral 11.

Device 11 includes an elongated tubular housing 13 made of a suitable strong and rigid material, such as aluminum. Housing 13 includes a first end 15 and a second end 17 and has a pair of opposed longitudinal slots 19 and 21, a pair of opposed holes 23 and 25 which are located near first end 15, a pair of opposed holes 27 and 29 which are located near second end 17 and a pair of opposed holes 31 and 33 which also located near second end 17 and spaced inward from holes 27 and 29.

Figure 7:
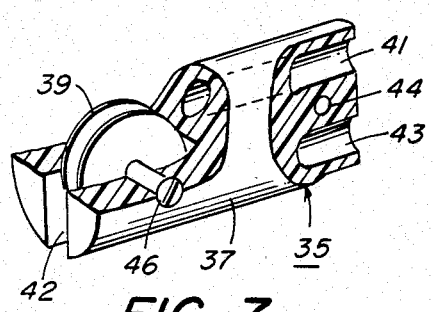
FIG. 7 is a perspective view partly broken away in section of the pulley in the device shown in FIG. 2.
Figure 8:
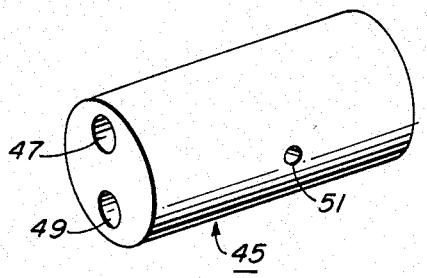
FIG. 8 is a perspective view of the adjustment block in the device shown in FIG. 2.

A pulley 35 is slidably mounted inside housing 13. Pulley 35, which is also shown in FIG. 7, includes an elongated generally cylindrically shaped block 37 which is made of a suitable material such as plastic and a pulley wheel 39 which may also be made of plastic. Block 37 includes a pair of longitudinal holes 41 and 43 and a transverse hole 44. Pulleywheel 39 is mounted by means of a bolt 46 for rotational movement within a longitudinal slot 42 in block member 37. An adjustment block 45 is also slidably mounted in housing 13 between pulley 35 and first end 15. Adjustment block 45, which is also shown on FIG. 8 is a generally cylindrically shaped block made of a suitable material, such as plastic, and includes a pair of longitudinal holes 47 and 49 and a transverse hole 51.

A compression spring 53 is disposed inside housing 13 between pulley 35 and adjustment block 45 for urging pulley 35 away from adjustment block 45.

Figure 9:
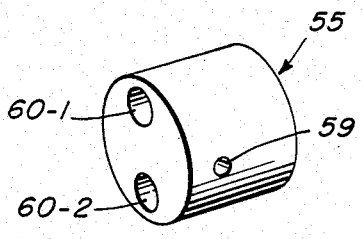
FIG. 9 is a perspective view of the end block in the device shown in FIG. 2.

An end block 55 is mounted on first end 15 of housing 13. End block 55 which is also shown in FIG. 9 is made of suitable material such as plastic and is fixedly secured to housing 13 by bolt 57 which extends through holes 23 and 25 in housing 13, through a transverse hole 59 in end block 55 and engages a nut 59. End block 55 is provided with a pair of longitudinal holes 60-1 and 60-2.

A first cotter pin 61 extends through holes 27 and 29 in housing 13 and serves to limit the movement of pulley 35 in the direction of second end 17. A second cotter pin 63 extends through holes 31 and 33 in housing 13 and hole 44 in pulley 35 for fixedly positioning pulley 35 in housing 13, when movement of pulley 35 within housing 13 is not desired. When movement of pulley 35 is desired, cotter pin 63 is removed.

Means are provided for selectively locking the position of adjustment block 45 within housing 13. The means include a pair of clamping blocks 65 which are adapted to be placed about housing 13, one on each side thereof, a bolt 67 and a nut 69. As can be seen, bolt 67 extends through a hole 71 in clamping block 65, through slots 19 and 21 in housing 13 and through hole 51 in adjustment block 45. Clamping blocks 65, one of which is also shown in FIG. 8 is a solid body and may be made of any suitable material, such as plastic. As can be seen, clamping block 65 includes a concave inner surface 72 which is sized and shaped to seat on the curved outer surface of housing 13.

Compression spring 53 is preferably sized so that it will be slightly under compression when adjustment 45 is not locked in any particular position within housing 13 (i.e. and is as a result in contact with end block 55).

Figure 11:
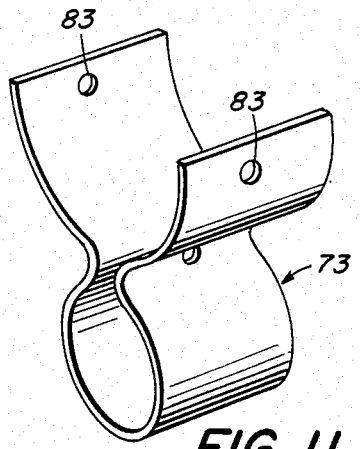
FIG. 11 is a perspective view of one of the mounting brackets in the device shown in FIG. 1.
Figure 10:
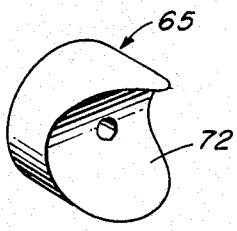
FIG. 10 is a perspective view of one of the clamping blocks shown in FIG. 2.
Figure 12:
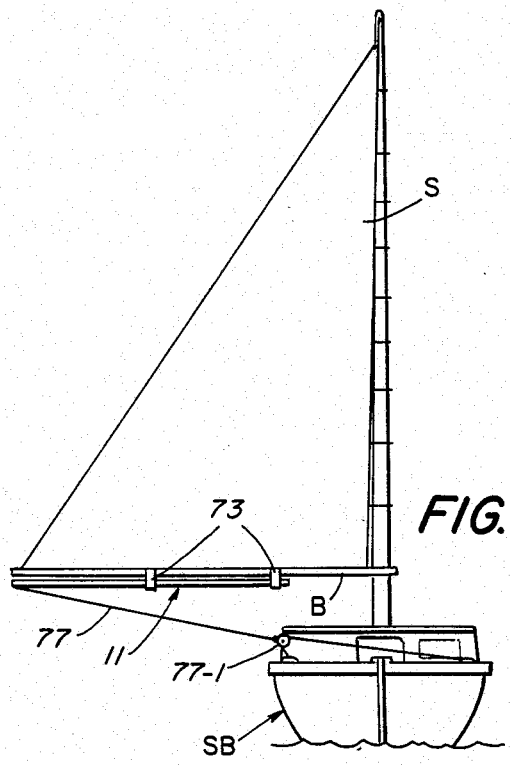
FIG. 12 is a simplified perspective view of the device shown in FIG. 1 mounted on a sailboat.

Device 11 further includes a pair of mounting brackets 73 which are fixedly mounted on housing 13 by screws 75 and blocks 76 and which are used for mounting device 11 onto the boom of a sail vehicle as will be hereinafter explained. The mounting brackets 73, one of which is shown in FIG. 11, may be made of aluminum or other suitable material.

A length of line 77 such as rope, wire or cable extends down through hole 60-1 in end block 55, through hole 47 in adjustment block 55, through compression spring 53, through hole 41 in pulley block 37 around pulley wheel 39 and back through hole 43 in pulley block 37, through compression spring 53, through hole 49 in adjustment block 45 and back out through hole 60-2 in end block 55.

Finally, device 11 includes an end cap 79 which is press fit into second end 17 of housing 13. In use, the device 11 is mounted on the boom B of a sail S in a sail vehicle such as a sail boat SB by brackets 73 (as shown in FIG. 8) and secured in place by bolts which extend through holes 83 in brackets 73 through holes (not shown) formed in the boom B and engage nuts (not shown). One end 77-1 of line 77 is secured to a pulley system attached to the main body of sail boat SB or some other convenient part of the body of sail boat SB and a knot 81 is formed at the other end 77-2 of the line 77 that is larger than hole 60-1 in end block 55 to limit inward movement of that end of the line in end block 55.

When cotter pin 63 is inserted in place (as shown in FIG. 1), pulley 35 will not slidably move within housing 13 and the device 11 will be the equivalent of a line of fixed length. As such, device 11 will not provide any automatic adjustment of line length to compensate for changes in wind pressure. On the other hand, when cotter pin 63 is removed, pulley 35 will not be fixed in place. Any increases in pressure on said S will produce increased pulling on line 77 causing pulley 35 to move in the direction of adjustment block 45 (against the pressure of compression spring 53). This movement will produce additional slack on end 77-1 of line 77 allowing boom M to change its angular position to relieve the excess wind pressure (i.e. spill the wind). As can be appreciated, the positioning (i.e. setting) of adjustment block 45 in housing 11 will determine the amount of increased pressure on line 45 that is needed to move pulley 35 toward block 45 against the pressure of spring 53 and provide additional slack. As block 45 is moved closer to pulley 35 (to the left in FIG. 1) and fixedly locked in locked in place, the amount of additional pressure needed to move pulley 35 will be increased. Thus, the amount of increased wind pressure needed to produce increased slack in line 75 can be varied (i.e. selectively set) according to the desires or needs of the vehicle operator.

As is readily apparent, clamping blocks 65 need not be attached to housing 13. Adjustment block 45 may be positioned in contact with end block 55 (and not set to provide any additional initial pressure on spring 53).

Typically, housing 13 may be a 5 foot aluminum tube having a thickness of 0.058" and an outside diameter of $1\frac{3}{8}$ inches, the spring 53 used with such a housing may be a number 523 compression spring having a length of $5\frac{1}{2}$ feet and line 77 may be a 7/32 nylon line having a length of 12 feet.

In another embodiment of the invention (not shown) a tension spring is used instead of a compression spring 53. The tension spring is disposed between cotter pin 61 and pulley 35 and fixedly attached to pulley 35. The adjustment block is eliminated and means such as a clamping brackets and bolts are attached to housing 13 behind pulley 35 to limit movement of pulley 35 in the direction of second end 15.

Figure 13:
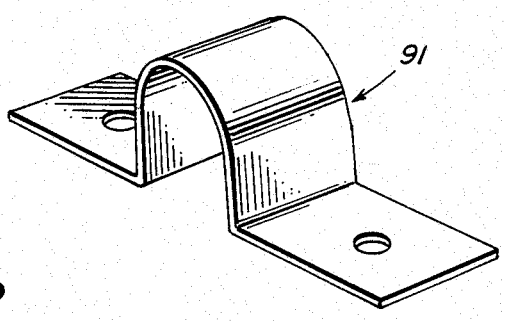
FIG. 13 is a perspective view of a modification of the mounting bracket shown in FIG. 7.

Instead of mounting device 11 on the boom B of sail boat SB and securing end 77-1 of line 77 to the body of sail boat SB, device 11 may be mounted on the body of sail boat SB and the end 77-1 of line 77 secured to the boom. One of the mounting brackets 91 for use in place of mounting brackets 73 for mounting device 11 to the body of sail boat SB is shown in FIG. 13. As can also be appreciated, this latter arrangement may also be used to attach the device to a sail that is not supported on a boom.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for use in automatically adjusting the angular position of a boom supporting the foot of a sail in a sailing vehicle relative to a mast in said sailing vehicle supporting the luff of said sail in said sailing vehicle in order to compensate for sudden gusts of wind and the like, said device comprising:

a. an elongated tubular housing having a first end and a second end,
b. a pulley slidably mounted in said housing,
c. an adjustment block slidably mounted in said housing between said first end and said pulley,
d. an end block fixedly mounted on said housing at said first end,
e. a compression spring disposed inside said housing between said pulley and said adjustment block for urging said pulley away from said adjustment block,
f. means for mounting said housing on said boom, and
g. a line extending into said housing through said first end around said pulley and back out of said housing through said first end and adapted to be secured at one end to said body of said sailing vehicle and provided with means at the other end for limiting inward movement of said line into said housing.

2. The device of claim 1 and further including means for selectively fixing the position of said adjustment block along the length of said housing.

3. The device of claim 2 and further including means for selectively locking the pulley at a fixed position in said housing.

4. The device of claim 3 and further including means limiting movement of said pulley toward said second end of said housing.

5. A device for use in automatically adjusting the angular position of a boom supporting the foot of a sail in a sailing vehicle relative to a mast in said sailing vehicle supporting the luff of said sail in said sailing vehicle in order to compensate for sudden gusts of wind and the like, said device comprising:

a. an elongated tubular housing having a first end and a second end,
b. a pulley slidably mounted in said housing,
c. an adjustment block slidably mounted in said housing between said first end and said pulley,
d. an end block fixedly mounted on said housing at said first end,
e. a compression spring disposed inside said housing between said pulley and said adjustment block for urging said pulley away from said adjustment block,
f. means for mounting said housing on said boom,
g. a line extending into said housing through said first end around said pulley and back out of said housing through said first end and adapted to be secured at one end to said body of said sailing vehicle and provided with means at the other end for limiting inward movement of said line into said housing.
h. means for selectively fixing the position of said adjustment block along the length of said housing,
i. means for selectively locking the pulley at a fixed position in said housing, and
j. means limiting movement of said pulley toward said second end of said housing,
k. said housing including a pair of opposed longitudinal slots, said adjustment block including a transverse hole and said means for selectively fixing the position of said adjustment block along the length of said housing comprising a screw adapted to fit through said two longitudinal slots and said hole in said adjustment block and a fastener for said bolt.

6. The device of claim 5 and wherein said pulley includes a transverse hole, said housing includes a pair of oppositely disposed transverse holes and said means for fixing the position of said pulley in said housing includes a fastener adapted to be inserted through said hole in said pulley and said holes in said housing.

7. The device of claim 6 and wherein said housing is made of a rigid material.

8. The device of claim 7 and wherein said pulley comprises a generally cylindrically shaped main body and a wheel rotably mounted thereon.

9. The device of claim 8 and wherein said mounting means for mounting said housing on said boom comprises a pair of brackets.

10. The device of claim 9 and wherein said adjustment block is a generally cylindrical body having a pair of longitudinal holes for receiving said line.

11. The device of claim 10 and further including an end cap fixedly mounted on said housing at said second end.

* * * * *